US006863196B1

(12) United States Patent
Carter et al.

(10) Patent No.: US 6,863,196 B1
(45) Date of Patent: Mar. 8, 2005

(54) APPARATUS FOR HANGING HATS

(76) Inventors: David W. Carter, 9225 Nesbit Lakes Dr., Alpharetta, GA (US) 30022; Beth E. Wingo-Carter, 9225 Nesbit Lakes Dr., Alpharetta, GA (US) 30022

( * ) Notice: Subject to any disclaimer, the term of this patent is extended or adjusted under 35 U.S.C. 154(b) by 0 days.

(21) Appl. No.: 10/281,454

(22) Filed: Oct. 25, 2002

(51) Int. Cl.[7] ..... A41D 27/22
(52) U.S. Cl. ..... 223/85; 211/30
(58) Field of Search ..... 223/85, DIG. 2, 223/DIG. 1, 98; 211/113, 169.1, 119.11, 30

(56) References Cited

U.S. PATENT DOCUMENTS

| | | | | | |
|---|---|---|---|---|---|
| D82,948 | S | | 12/1930 | Livington | |
| 1,815,673 | A | | 7/1931 | Kelley | |
| 2,473,408 | A | * | 6/1949 | Alkin | 223/96 |
| 2,510,452 | A | * | 6/1950 | Witt | 211/85.3 |
| 2,580,193 | A | | 12/1951 | Richterkessing | 211/113 |
| 3,343,683 | A | * | 9/1967 | Wheeler | 211/89.01 |
| 3,896,931 | A | * | 7/1975 | Franklin | 206/326 |
| 4,169,534 | A | * | 10/1979 | Donovan | 223/96 |
| 4,261,121 | A | * | 4/1981 | Coon | 40/332 |
| 4,474,316 | A | * | 10/1984 | Philibert | 223/88 |
| D295,811 | S | * | 5/1988 | Larsson | D6/326 |
| 4,778,088 | A | | 10/1988 | Miller | 223/91 |
| 4,884,727 | A | * | 12/1989 | Blanchard | 223/93 |
| 5,033,660 | A | | 7/1991 | Kelly | 223/85 |
| D328,194 | S | | 7/1992 | Garrison | D6/317 |
| 5,178,306 | A | | 1/1993 | Petrou | 223/96 |
| 5,515,978 | A | | 5/1996 | Moran | 211/30 |
| 5,890,638 | A | | 4/1999 | Woloshen | 224/247 |
| 6,161,703 | A | * | 12/2000 | Mihok | 211/31 |
| 6,233,910 | B1 | * | 5/2001 | Hataya | 53/589 |

* cited by examiner

*Primary Examiner*—John J. Calvert
*Assistant Examiner*—James G Smith
(74) *Attorney, Agent, or Firm*—Baker Donelson Bearman Caldwell & Berkowitz

(57) ABSTRACT

An apparatus (10) for hanging hats (11) comprises a hanger (12) that has a longitudinal axis. The hanger (12) includes a frame (16), across member (18) suspended from the frame and a hook (20) attached to the frame. A plurality of fasteners (14) mounts to the cross member (18) for sliding movement between a forward position and a rearward position along the longitudinal axis. Each of the fasteners (14) includes a pair of clasping members (40, 42)having a pair of clasping surfaces (49, 50) closeable upon one another for holding objects in planes extending generally transverse to the longitudinal axis. The fasteners (14) may be slid forwardly or rearwardly for sorting hats attached to the fasteners using an ergonomically advantageous motion.

8 Claims, 4 Drawing Sheets

10
12
14
18
22
26
27
62
64
66
68
70
72
74
76

APPARATUS FOR HANGING HATS

TECHNICAL FIELD

This invention relates generally to apparatuses for hanging garments, and particularly to hangers for hanging multiple hats.

BACKGROUND OF INVENTION

When hats, baseball caps, visors and other accessories are not being worn, they are commonly stored in closets upon shelves, or upon hooks. The task of storing a hat on a shelf or a hook is often undertaken carelessly by one simply tossing the hat haphazardly amidst other hats, accessories or clothing. Quite frequently, such careless and haphazard storage causes hats to become folded, crushed or otherwise damaged through inadvertent contact with other objects.

Damage to hats caused by haphazard storing can be reduced by minimizing contact with the hat by other objects. For example, hats may be carefully spaced apart from other accessories and clothing on a shelf. However, providing individual shelf space for each hat often requires considerable shelf space to be consumed unnecessarily and requires time and effort to be spent carefully arranging objects on a shelf so as to avoid contact with the subject hat. Where one has numerous hats, it is usually impractical to provide and maintain separate shelf spaces to accommodate each hat.

In addition to shelves, coat hooks, normally made of metal or plastic, have long been used to store hats and accessories temporarily when not being worn. Such hooks are commonly mounted to doors, walls or free standing posts. A single hook may be used for hanging a single hat apart from other objects and thereby reducing the potential for other objects to cause damage to that hat. However, using a single hook to store one hat is often wasteful as it underutilizes the hook, which is typically capable of holding much more weight and more objects than a single hat.

To make better use of a hook, multiple accessories are often hung collectively on one hook. However, removal of a desired accessory from among other accessories stored collectively on a single hook commonly requires one to undertake an inefficient and ergonomically challenging process. For example, to gain access to a desired accessory from within a stack of multiple accessories on a hook, one is often required to remove multiple accessories from the hook. Once removed from the hook, the other accessories must be stored temporarily as by holding multiple accessories in one's hands or across one's forearms or both which often requires considerable coordination. Alternatively, one may place the removed accessories down elsewhere as on a bed or a countertop, or hang them on nearby hooks. Once the desired accessory has been accessed and removed from the hook, the other accessories must be gathered and re-hung on the hook. This burdensome process must be repeated for each accessory that is desired to be worn.

It is thus seen that a need exists for an apparatus capable of storing multiple hats or accessories efficiently and ergonomically in a small amount of space. It is to the provision of such that the present invention is particularly directed.

SUMMARY OF THE INVENTION

In a preferred form of the invention, an apparatus for hanging hats comprises a hanger having a frame, a cross member suspended from the frame and a hook attached to the frame. The hook is adapted to carry the frame and the cross member upon a structure. The hanger extends along a generally longitudinal axis. A plurality of fasteners mounts to the cross member for sliding movement between a forward position and a rearward position along the longitudinal axis. Each of the fasteners includes a pair of clasping members having a pair of clasping surfaces closeable upon one another for holding objects in a plane extending generally transverse to the longitudinal axis of the hanger. With the hook suspended from a structure, a plurality of hats may be held by the plurality of fasteners in planes oriented generally parallel to one another and transverse to the longitudinal axis of the hanger, and the fasteners may be slid forwardly or rearwardly for sorting the hats using an ergonomically advantageous motion.

In another preferred form of the invention, a hanger comprises a frame having a support member including a first end and a second end. A first flange depends from the first end. A second flange depends from the second end. A hook attaches to the support member. The frame extends along a generally longitudinal axis. A cross member is suspended from the first flange and the second flange. A plurality of fasteners slideably attaches to the cross member. Each of the fasteners includes a pair of clasping members having a pair of generally planar clasping surfaces closeable upon one another for clasping objects. The generally planar clasping surfaces extend transverse to the longitudinal axis of the frame. The plurality of fasteners may clasp multiple accessories and slideably hold the accessories in planes oriented generally parallel to one another and transverse to the longitudinal axis of the frame.

In another preferred form of the invention, a hanger comprises a frame having a forward end and a rear end. A hook attaches to the frame for supporting the frame upon a structure. A cross member attaches to the frame. The cross member extends in a longitudinal axis. A plurality of fasteners slideably attach to the cross member for hanging objects transverse to the longitudinal axis of the cross member. With the hook of the frame attached to a structure a person may stand at the forward end of the frame and selectively slide the fasteners forwardly and rearwardly along the cross member using his hands alternatingly in an ergonomically advantageous motion thereby sorting objects attached to the fasteners.

DETAILED DESCRIPTION OF THE DRAWINGS

Figure 1:
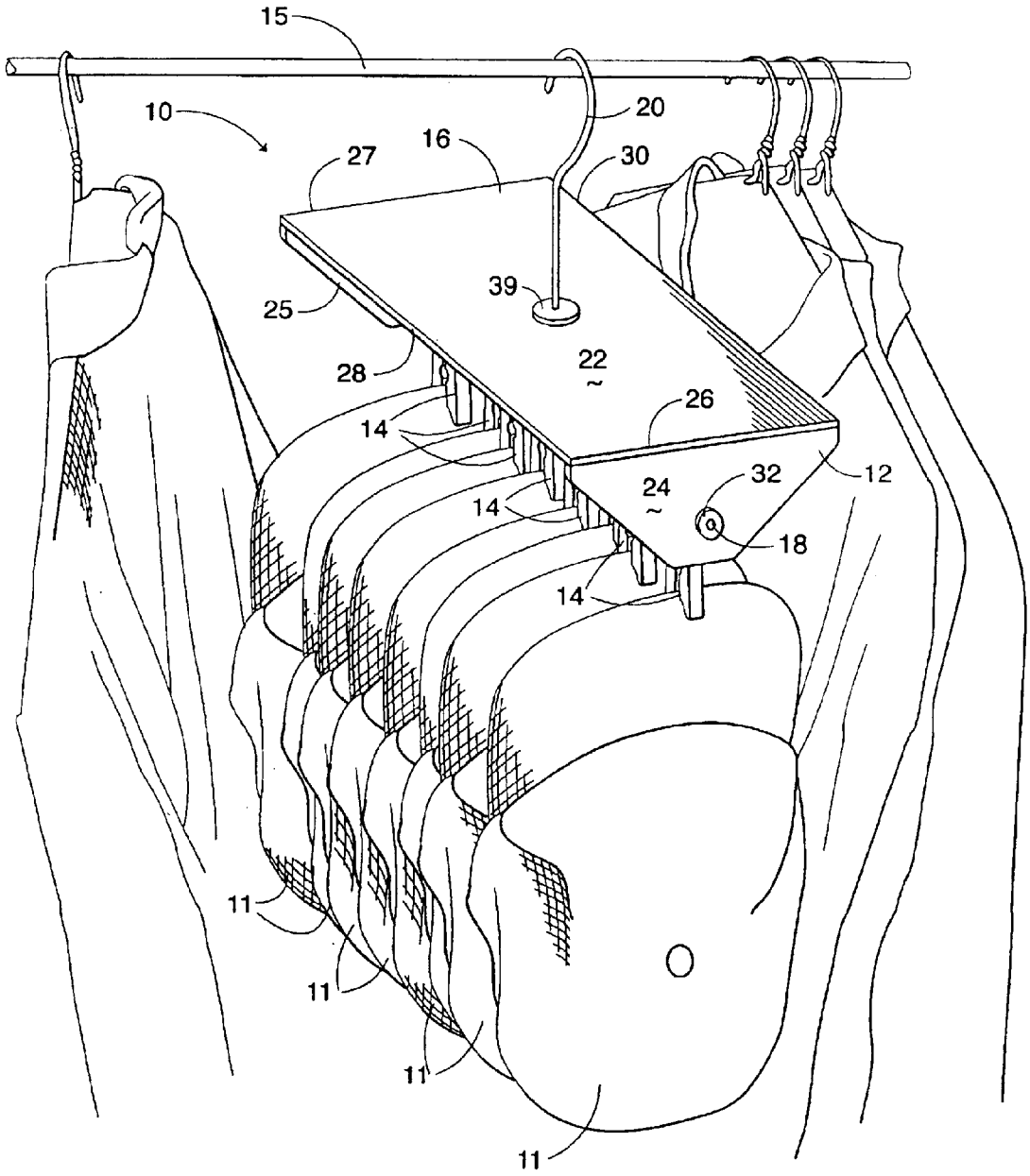
FIG. 1 illustrates a perspective view of an apparatus for hanging hats shown in use in a closet with a plurality of hats fastened to the apparatus.
Figure 2:
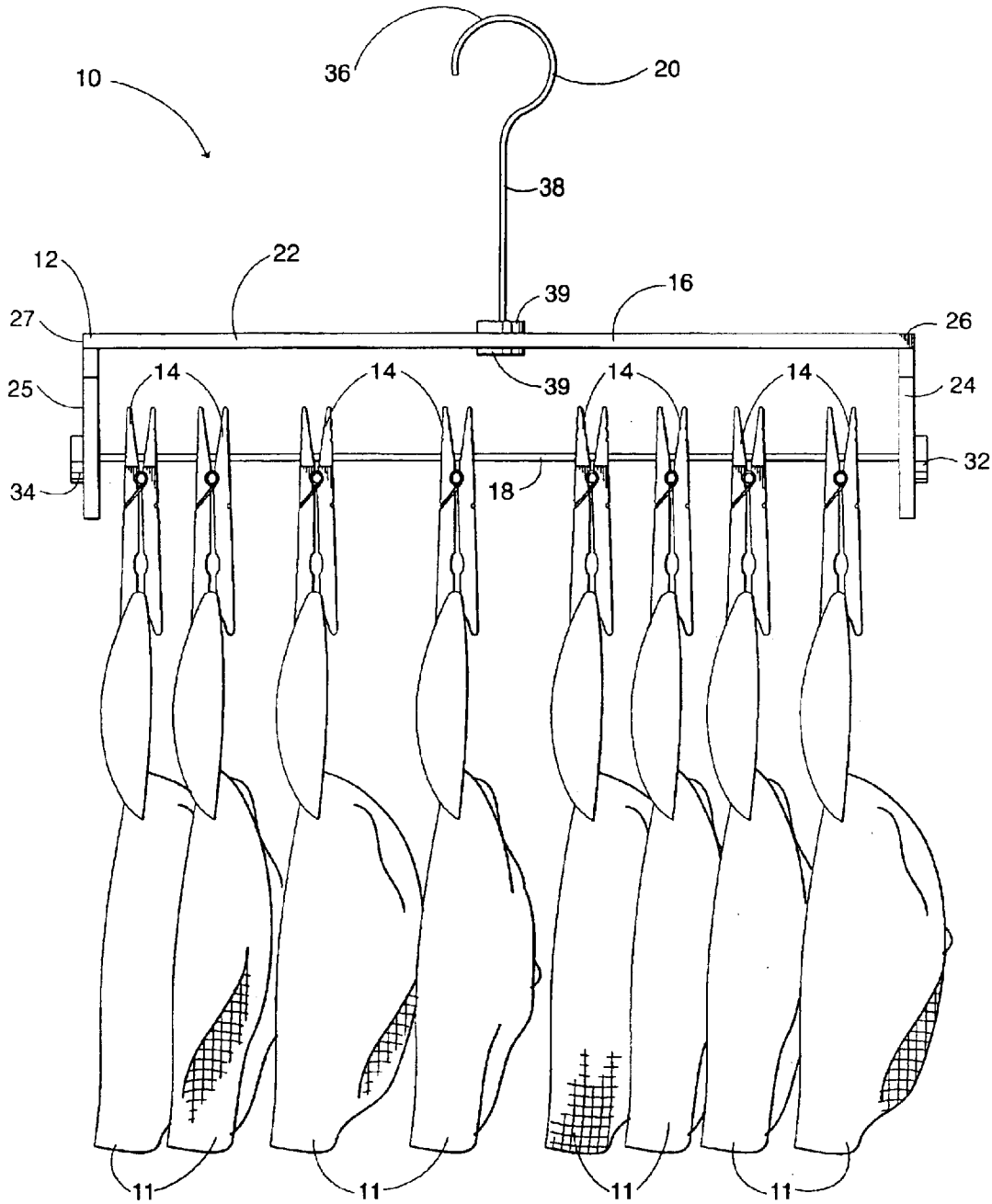
FIG. 2 illustrates a side view of the apparatus shown in FIG. 1.

Referring now in more detail to the drawings in which like numerals refer to like parts throughout the several views, FIG. 1 illustrates a perspective view of an apparatus 10 for hanging hats shown in use in a closet with a plurality of hats 11 fastened to the apparatus. FIG. 2 illustrates a side view of the hanging apparatus 10 shown in FIG. 1.

The apparatus 10 includes a hanger 12 and a plurality of fasteners 14 suspended from a horizontal rack 15. The hanger 12 includes a frame 16, a cross member 18 and a hook 20. The frame 16 is rigid support structure from which the cross member 18 is suspended. The frame 16 includes a support member 22 and a pair of flanges 24 and 25. The support member 22 extends longitudinally between a first end 26, i.e. the forward end, and a second end 27, i.e. the rearward end, and laterally between a first side 28 and a second side 30. The support member 22 has a substantially planar surface that extends along a longitudinal axis between the first end 26 and the second end 27.

The flanges 24 and 25 attach to and depend from the first end 26 and the second end 27 respectively. Each of the flanges 24 and 25 defines an opening for receiving an opposing end of the cross member 18. The cross member 18 is preferably a metal rod having threads at opposing distal ends. A pair of threaded nuts 32, 34 attach to the opposing distal ends of the cross member 18 to secure the cross member to the flanges 24 and 25. The cross member 18 has a longitudinal axis substantially parallel to the longitudinal axis of the support member 22. The hook 20 is preferably a metal rod having a curved end 36 and a straight end 38. The support member 22 has an opening for receiving a distal portion of the straight end 38 of the hook 20. The distal portion of the straight end 38 of the hook 20 is preferably threaded for receiving a pair of threaded nuts 39 that secure the support member 22 to the hook. The opening in the support member 22 for receiving the hook 20 is preferably sized sufficiently wide enough to permit rotational movement of the hook relative to the support member.

Figure 3:
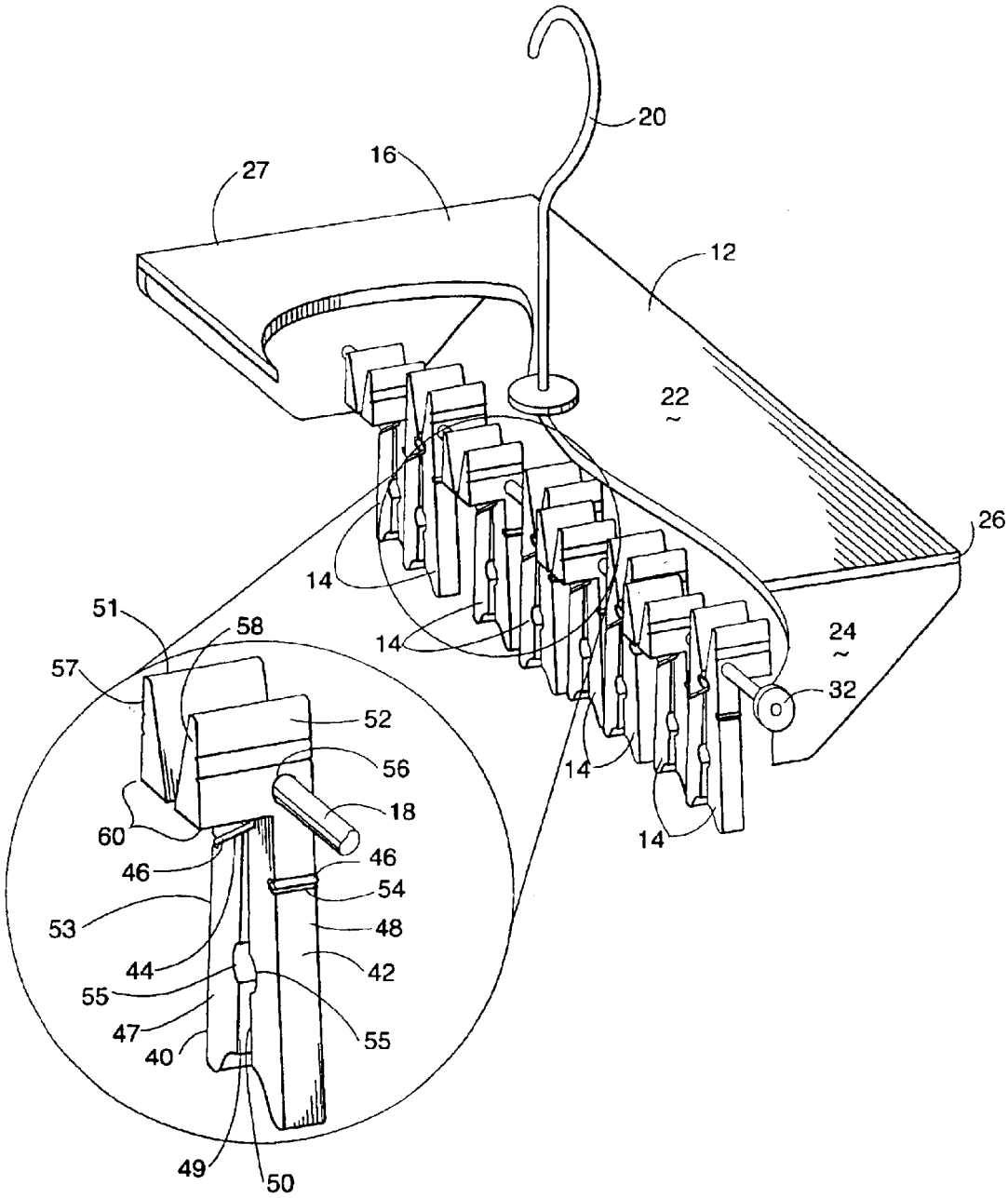
FIG. 3 illustrates a perspective view of the apparatus shown in FIG. 1 with a portion of the frame of the apparatus cutaway and one of the fasteners shown in an exploded view.

FIG. 3 illustrates a perspective view of the apparatus 10 shown in FIG. 1 with a portion of the frame 16 cutaway and with an exploded view of one of the fasteners 14. Each of the fasteners 14 has a pair of clasping members 40, 42 joined together by a spring 44. The spring 44 includes a coil 45 and a pair of legs 46 extending from the coil. Each of the clasping members 40, 42 includes a body 47, 48 having a clasping surface 49, 50 at one end and a gripping portion 51, 52 at an opposing end. Each body 47, 48 is preferably a rigid stick of wood or plastic. Each body 47,48 defines a first detent 53, a second detent 54, and a third detent 55. The first detent 53 of each clasping member 40, 42 is adapted to receive an opposing side of the coil 45 to hold the coil between a pair of detents 53. The second detents 54 of each clasping member 40, 42 are adapted to receive one of the legs 46 of the spring 44 for joining a pair of the clasping members 40, 42 together. The third detents 55 are defined adjacent the clasping surfaces 49, 50 to assist the fasteners 14 in clasping objects.

The clasping surfaces 49, 50 of each fastener 14 align with one another. Each of the springs 44 biases the clasping surfaces 49, 50 of a fastener 14 together for clasping and holding objects between the clasping surfaces in a plane generally transverse to the cross member 18 and to the longitudinal axis of the support member 22. Each of the gripping portions 51, 52 defines an opening 56 for slideably receiving the cross member 18. Each of the openings 56 has a diameter sufficiently wider than a cross-sectional diameter of the cross member 18 to permit sliding movement of the respective clasping member 40, 42 on the cross member 18 and to permit the fasteners 14 to rotate radially about the cross member. The openings 56 are preferably elliptical or oval shaped to permit sliding and rotational movement of the fasteners 14 about the cross member 18 with the clasping surfaces 49, 50 biased together or with the gripping portions 51, 52 pinched together.

Each of the gripping portions 51, 52 also includes an offset tab 57, 58. The offset tabs 57, 58 are extensions of the gripping portions 51, 52 that project outwardly from the bodies 47, 48 of the clasping members 40, 42. Each of the offset tabs 57 aligns with one another offset tab 58 to form a handle 60 for a fastener 14. The spring 44 biases each pair of offset tabs 57, 58 apart from one another.

The plurality of fasteners 14 mount to the cross member 18 adjacent one another. Preferably, the handles 60 of adjacent fasteners 14 project outwardly from the cross member 18 in opposing directions. As shown in FIG. 3, the handles 60 of adjacent fasteners 14 are alternatingly offset from the cross member 18 in different directions.

In operation, a user squeezes the handle 60 of one of the fasteners 14 to push the gripping portions 51, 52 together and to pull the clasping surfaces 49, 50 apart from one another. With the clasping surfaces 49, 50 apart from one another, an object, such as the brim of a hat, is inserted between the clasping surfaces. The handle 60 of the fastener is released to enable the spring 44 to close the clasping surfaces 49, 50 and the third detents 55 toward one another to clasp the object and hold the object between the clasping surfaces in a plane transverse to the longitudinal axis of the hanger 12. Repeating this process, a user may load an object into each of the fasteners 14 so that multiple objects are held by the fasteners in adjacent planes parallel to one another and transverse to the cross member 18 and to the longitudinal axis of the hanger 12.

Figures 4A, 4B, 4C:
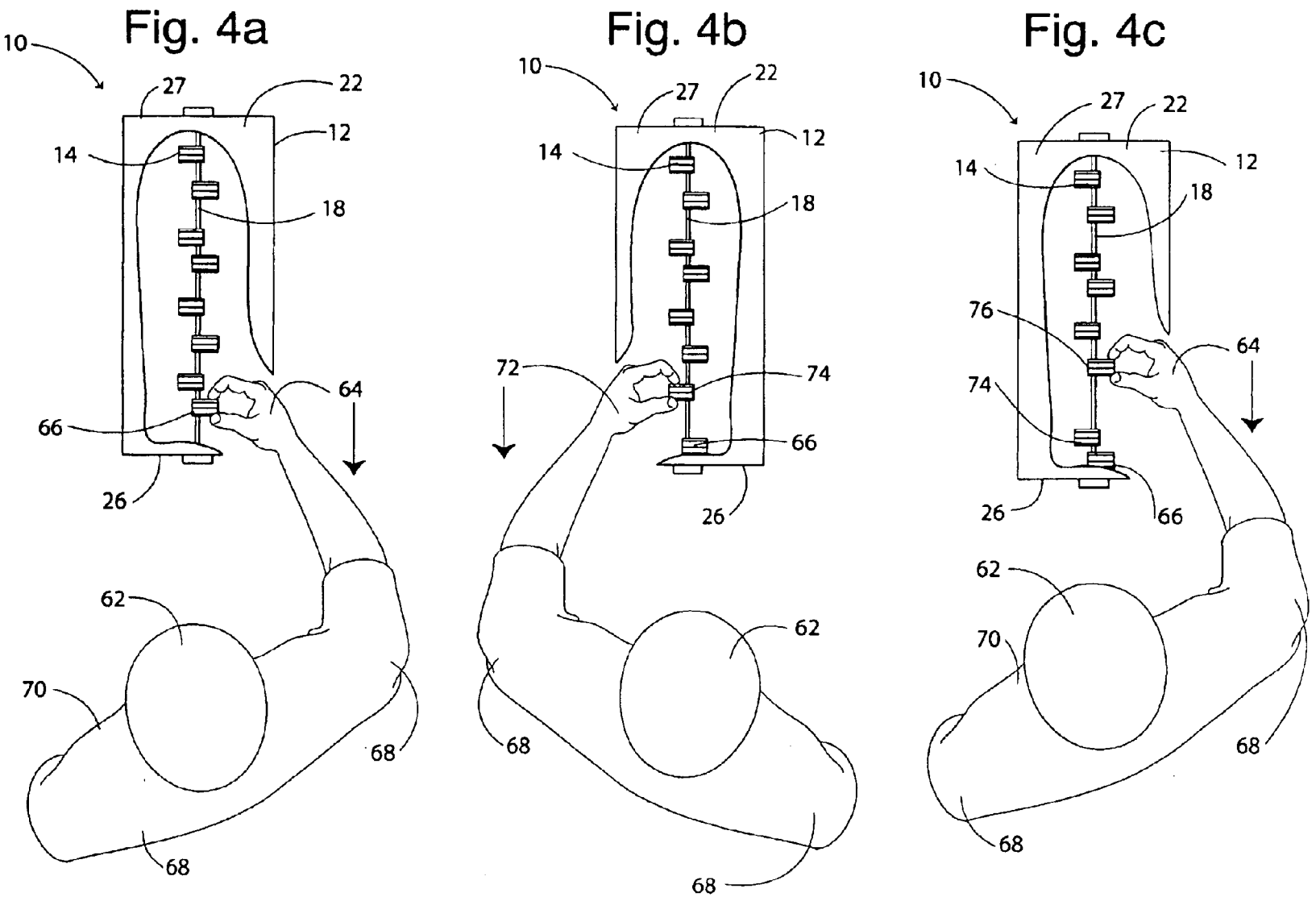
FIGS. 4*a*, 4*b* and 4*c* illustrate top views of the apparatus shown in FIG. 3 with a user using alternate hands in an ergonomically advantageous motion to grasp and slide adjacent fasteners upon a cross member.

FIGS. 4*a*, 4*b* and 4*c* illustrate top views of the apparatus 10 shown in FIG. 3 with a user 62 using alternate hands 64, 72 in an ergonomically advantageous motion to grasp and slide adjacent fasteners 14 upon the cross member 18. As shown in FIG. 4*a*, a user 62 standing at a forward end 26 of the hanger 12 uses his right hand 64 to grasp the handle 60 of a first fastener 66 and slide the first fastener forwardly toward the forward end. To reach the handle 60 of the first fastener 66 with his right hand 64, the user 62 rotates his shoulders 68 and upper torso 70 counterclockwise. To pull the first fastener 66 toward the forward end 26 of the hanger 12, the user 62 may pull his right hand 64 toward his upper torso 70 by retracting his right arm or by simply rotating his shoulders 68 and upper torso 70 clockwise.

As shown in FIG. 4*b*, the user 62 uses his left hand 72 to grasp the handle 60 of a second fastener 74 and slide the second fastener 74 forwardly toward the forward end 26. To reach the handle 60 of the second fastener 74 with his left hand 72, the user 62 rotates his shoulders 68 and upper torso 70 clockwise. To pull the second fastener 74 in a forward direction toward the forward end 26 of the hanger 12, the user 62 may pull his left hand 72 toward his upper torso 70 by retracting his left arm or by simply rotating his shoulders 68 and upper torso 70 counterclockwise.

As shown in FIG. 4*c*, the user 62 uses his right hand 64 to grasp the handle 60 of a third fastener 76 and slide the third fastener 76 forwardly toward the forward end 26. To reach the handle 60 of the third fastener 76 with his right hand 64, the user 62 rotates his shoulders 68 and upper torso 70 counterclockwise. To pull the third fastener 76 in a forward direction toward the forward end 26 of the hanger 12, the user 62 may pull his right hand 64 toward his upper torso 70 by retracting his right arm or by simply rotating his shoulders 68 and upper torso 70 clockwise.

In this manner, the user 62 may undertake an ergonomically advantageous rowing type of motion to sort through objects attached to the fasteners 14. It should be appreciated that the fasteners 14 are slideable upon the cross member 18 both in a forward direction toward the forward end 26 of the hanger 12 and in a rearward direction toward the rearward end 27 of the hanger. Thus, the user may use alternate hands to grasp and slide adjacent fasteners 14 along the cross member 18 as desired in order to sort through the fasteners using an ergonomically advantageous motion. As the user 62 sorts through the fasteners 14, he may also grasp a handle 60 and rotate a fastener radially to push or pull the clasping surfaces 49, 50 out of alignment with the other fasteners. By doing so, the user 62 is able to rotate an object attached to the clasping surfaces 49, 50 radially about the cross member 18 into a more advantageous position to assist in viewing the object apart from other objects attached to other fasteners.

When the user 62 determines that a particular fastener 14 is holding a hat 11 or other accessory he desires to wear, the user squeezes the handle 60 of the respective fastener 14 to which the desired hat is attached to push the respective offset tabs 57, 58 together whereupon the respective clasping surfaces 49, 50 are pulled apart and the desired hat is released. To assist in the process of squeezing the handle 60 of a fastener 14 using one of his hands, the user 62 may use an alternate hand to grip the forward end 26 of the frame 16 and rotate the frame and cross member 18 upon the hook 20 so as to place the handle in an ergonomically advantageous position for being squeezed. Once the fastener 14 from which the desired hat 11 has been removed is unloaded, it may be re-loaded with another hat or other accessory adjacent other hats and accessories hanging from adjacent fasteners whereupon the accessories may remain stored free from damage caused by inadvertent crushing or folding.

While the apparatus 10 has been illustrated in FIG. 1 as hanging from the horizontal rack 15 of a closet, it should be appreciated that the apparatus may be hung from virtually any upright structure having a projection to which the hook 20 is capable of attaching. Additionally, the width of each offset tab 57, 58 of the fasteners 14 is preferably 2-1/2 to 3 times the width of the body 47, 48 of the respective clasping member 40, 42 from which it projects. Thus, for a body 47, 48 of a clasping member 40, 42 that is 1 cm, the handle 60 preferably projects outwardly from the body a distance of 2.5 cm to 3 cm.

The fasteners 14 are preferably clamping devices similar to clothespins. However, it should be understood that the fasteners 14 may be comprised of any number of configurations of clamps or clips having clasping surfaces 49, 50 between which objects may be secured to the cross member 18 and held in planes transverse to the cross member. The fasteners 14 need not have clasping members 40, 42 that are similar to one another or biased against one another so long as the clasping surfaces 49, 50 of the fasteners are capable of clasping objects therebetween.

The frame 16 is preferably comprised of a rigid sheet of transparent plastic material to assist the user 62 in viewing the fasteners 14 and the objects 11 held by the fasteners. However, the frame 16 may be comprised of other materials and may be configured in alternate embodiments that suspend the cross member 18 from the hook 20. For example, the frame 16 may be a single rod that bisects the cross member 18 and joins the cross member to the hook 20. In this alternate embodiment, the frame 16 and the cross member 18 form an inverted T-shaped structure suspended from the hook 20 wherein the cross member has opposing sides is bisected by the frame. Fasteners 14 attached to the cross member 18 in this alternate embodiment are moveable on the opposing sides of the cross member 18. In this alternate embodiment, the pair of nuts 32, 34 attached to opposing distal ends of the cross member 18 serve as stops that prevent the fasteners 14 from sliding off the cross member.

The frame 16 and the hook 20 may be comprised of injection molded plastic or other material and may in fact be molded together. The cross member 18 that is suspended from the frame 16 is preferably linear, but may also be curvilinear. In a preferred embodiment of the frame 16, the sides 28 and 30 of the support member 22 are spaced apart a width approximately the same as that of the objects 11 hung from the fasteners 14 so as to inhibit contact with clothing, accessories or other objects hung adjacent the apparatus 10. Similarly, the frame 16, having the support member 22 atop the cross member 18 and the flanges 24, 25 adjacent the cross member, inhibits dust and other particulates from collecting on hats 11 and objects hung from the fasteners 14.

From the foregoing, it is seen that a new apparatus for hanging clothing accessories is now provided which overcome problems associated with those of the prior art. It should, however, be understood that the just described hanger merely illustrates principles of the invention in preferred forms. Many modifications, additions and deletions may, of course, be made thereto without departure from the spirit and scope of the invention as set forth in the following claims.

We claim:

1. An apparatus for hanging hats comprising a hanger having a frame including a support member having a first end and a second end opposite said first end, a first flange depending from said first end, and a second flange depending from said second end, a cross member suspended from said first flange and said second flange, and a hook attached to said frame, said support member comprising a substantially planar sheet of plastic material extending between a pair of sides, said hook being adapted to carry said frame and said cross member upon a structure, said hanger extending along a generally longitudinal axis, and a plurality of fasteners mounted to said cross member for sliding movement between a forward position and a rearward position along the longitudinal axis, each of said fasteners including a pair of clasping members having a pair of clasping surfaces closeable upon one another for holding objects in a plane extending generally transverse to the longitudinal axis of said hanger, whereby with the hook suspended from a structure, a plurality of hats may be held by the plurality of fasteners in planes oriented generally parallel to one another and transverse to the longitudinal axis of the hanger, and the fasteners may be slid forwardly or rearwardly for sorting the hats using an ergonomically advantageous motion, and the support member may shield objects held by the fasteners from inadvertent contact with other objects.

2. An apparatus for hanging hats comprising a hanger having a frame, a cross member suspended from said frame and a hook attached to said frame, said hook being adapted to carry said frame and said cross member upon a structure, said hanger extending along a generally longitudinal axis, and a plurality of fasteners mounted to said cross member for sliding movement between a forward position and a rearward position along the longitudinal axis, each of said fasteners including a pair of clasping members having a pair of clasping surfaces closeable upon one another for holding objects in a plane extending generally transverse to the longitudinal axis of said hanger and a handle adapted for being grasped by a hand for sliding said fastener on said cross member, each said handle projecting outwardly from said cross member in a direction different than handles of adjacent fasteners, whereby with the hook suspended from a structure, a plurality of hats may be held by the plurality of fasteners in planes oriented generally parallel to one another and transverse to the longitudinal axis of the hanger, and the fasteners may be slid forwardly or rearwardly for sorting the hats using an ergonomically advantageous motion.

3. An apparatus for hanging hats comprising a hanger having a frame including a support member having a first end and a second end opposite said first end, a first flange depending from said first end, and a second flange depending from said second end, a cross member suspended from said first flange and said second flange, and a hook attached to said frame, said hook being adapted to carry said frame and said cross member upon a structure, said hanger extending along a generally longitudinal axis, and a plurality of fasteners mounted to said cross member for sliding movement between a forward position and a rearward position alone the longitudinal axis, each of said fasteners including a pair of clasping members having a pair of clasping surfaces closeable upon one another for holding objects in a plane extending generally transverse to the longitudinal axis of said hanger, each of said clasping members having a handle that is alternatingly offset about said cross member such that a user may use alternate hands to grasp and slide handles of adjacent fasteners whereby with the hook suspended from a structure, a plurality of hats may be held by the plurality of fasteners in planes oriented generally parallel to one another and transverse to the longitudinal axis of the hanger, and the fasteners may be slid forwardly or rearwardly for sorting the hats using an ergonomically advantageous motion.

4. A hanger comprising a frame having a support member including a first end and a second end, a first flange depending from said first end, a second flange depending from said second end and a hook attached to said support member, said frame extending along a generally longitudinal axis, said support member comprising a substantially planar sheet of plastic material extending between a pair of sides, a cross member suspended from said first flange and said second flange, and a plurality of fasteners slideably attached to said cross member, each of said fasteners including a pair of clasping members having a pair of generally planar clasping surfaces closeable upon one another for clasping objects, said generally planar clasping surfaces extending transverse to the longitudinal axis of said frame, whereby the plurality of fasteners may clasp multiple accessories and slideably hold the accessories in planes oriented generally parallel to one another and transverse to the longitudinal axis of the frame and the support member may shield objects held by the fasteners from inadvertent contact with other objects.

5. A hanger comprising a frame having a support member including a first end and a second end, a first flange depending from said first end, a second flange depending from said second end and a hook attached to said support member, said frame extending along a generally longitudinal axis, a cross member suspended from said first flange and said second flange, and a plurality of fasteners slideably attached to said cross member, each of said fasteners including a pair of clasping members having a pair of generally planar clasping surfaces closeable upon one another for clasping objects, said generally planar clasping surfaces extending transverse to the longitudinal axis of said frame, each said fastener including a handle adapted for being grasped by a hand for sliding said fastener on said cross member, each said handle projecting outwardly from said cross member in a direction different than handles of adjacent fasteners whereby the plurality of fasteners may clasp multiple accessories and slideably hold the accessories in planes oriented generally parallel to one another and transverse to the longitudinal axis of the frame.

6. The apparatus of claim 5 wherein each said handle is alternatingly offset about said cross member such that a user may use alternate hands to grasp and slide handles of adjacent fasteners in an ergonomically advantageous motion.

7. A hanger comprising a frame having a forward end and a rear end, a hook attached to said frame for supporting said frame upon a structure, a cross member attached to said frame, said cross member extending in a longitudinal axis, and a plurality of fasteners slideably attached to said cross member for hanging objects transverse to the longitudinal axis of said cross member, each said fastener including a handle adapted for being grasped by a person for sliding said fastener on said cross member, each said handle projecting outwardly from said cross member in a direction different than handles of adjacent fasteners, whereby with the hook attached to a structure a person may stand at the forward end of the frame and selectively slide the fasteners forwardly and rearwardly along the cross member using his hands alternatingly in an ergonomically advantageous motion thereby sorting objects attached to the fasteners.

8. The apparatus of claim 7 wherein each said handle is alternatingly offset about said cross member such that a user may use alternate hands to grasp and slide adjacent handles.

* * * * *